US005346556A

United States Patent [19]

Perry et al.

[11] Patent Number: 5,346,556

[45] Date of Patent: Sep. 13, 1994

[54] LATHING AND CLEANING PROCESS FOR PHOTORECEPTOR SUBSTRATES

[75] Inventors: Phillip G. Perry, Webster; Gene W. O'Dell, Williamson; Thomas P. Debies, Webster, all of N.Y.

[73] Assignee: Xerox Corporation, Stamford, Conn.

[21] Appl. No.: 143,721

[22] Filed: Nov. 1, 1993

[51] Int. Cl.[5] ..... B08B 3/04; B08B 3/08; C23G 1/02

[52] U.S. Cl. ..... 134/2; 134/3; 134/41; 134/26

[58] Field of Search ..... 134/2, 3, 41, 26

[56] References Cited

U.S. PATENT DOCUMENTS

| | | | |
|---|---|---|---|
| 3,000,826 | 9/1961 | Gililland | 252/49.3 |
| 3,079,340 | 2/1963 | Reamer | 252/49.3 |
| 3,773,579 | 11/1973 | Michelson et al. | 156/21 |
| 3,833,502 | 9/1974 | Leary et al. | 252/49.5 |
| 4,169,068 | 9/1979 | Harita et al. | 134/3 |
| 4,769,162 | 9/1988 | Remus | 252/18 |
| 5,110,494 | 5/1992 | Beck | 134/2 |
| 5,170,683 | 12/1992 | Kawada et al. | 82/1.11 |
| 5,185,235 | 2/1993 | Sato et al. | 134/40 |
| 5,207,838 | 5/1993 | Googin et al. | 134/42 |
| 5,215,675 | 6/1993 | Wilkins et al. | 134/2 |
| 5,279,677 | 1/1994 | Das | 134/3 |

*Primary Examiner*—Richard O. Dean
*Assistant Examiner*—Zeinab El-Arini
*Attorney, Agent, or Firm*—Oliff & Berridge

[57] ABSTRACT

A method of cleaning a substrate includes:

(1) lathing a substrate surface with a cutting fluid composition containing (A) an antioxidant, (B) a surfactant, (C) a lubricant, and (D) water;

(2) rinsing the lathed substrate surface with high quality deionized water having a resistivity of at least 2M ohm-cm;

(3) immersing the rinsed lathed substrate surface in a bath of high quality deionized water having a resistivity of at least 2M ohm-cm; and (4) removing the substrate from the bath of deionized water at a rate low enough to prevent water droplets from forming on the substrate.

24 Claims, No Drawings

LATHING AND CLEANING PROCESS FOR PHOTORECEPTOR SUBSTRATES

BACKGROUND OF THE INVENTION

This invention relates to photoreceptor substrates. More particularly, this invention relates to methods of lathing and cleaning photoreceptor substrates.

Many electrophotographic copiers, digital copiers, laser printers, and the like contain an electrophotographic photoreceptor wherein a photoconductive layer is provided on a rotatable drum-like substrate. The substrate may be made by machining the surface of a pipe, and a cutting fluid is normally used in this process. The cutting fluid is used to cool, lubricate, and clean the substrate. Many current processes for machining photoreceptor substrates use a petroleum-based cutting fluid.

For inspection purposes and to prepare the substrates for final cleaning and coating of photoconductor layers, the substrates are cleaned after machining to remove residual cutting fluid. Typically, petroleum residues on a substrate are removed by methods using an ultrasonic vapor degreaser with a chlorine solvent, such as, for example, 1,1,1-trichloroethane, trichloroethylene, perchloroethylene, methylene chloride, and the like. However, the use of such solvents can cause problems of environmental contamination and working safety from the viewpoint of ozone layer destruction, carcinogenicity and the like.

Alternatives to chlorine-containing solvents include aliphatic hydrocarbons such as kerosene or strong acid-based detergents. However, these alternatives can present new problems including fire risks and waste neutralization.

A preferred alternative to chlorine solvents would be a neutral aqueous cleaner. A number of commercial aqueous cutting fluids which are cleaned with neutral aqueous cleaners have been found to be unsatisfactory. A major problem with these cutting fluids is that they either attack metal on the substrate surface or alter the substrate surface chemistry, especially with aluminum substrates, so that the substrate has the undesirable characteristic of wetting after subseguent cleaning.

SUMMARY OF THE INVENTION

This invention provides a method of cleaning photoreceptor substrates, wherein the residues of the cutting fluid can be removed from the substrate by deionized water alone. Because deionized water can be used to remove the cutting fluid residues, the removal of the cutting fluid residues from the substrate does not pose a risk to the environment or to working safety. Furthermore, the cutting fluid of this invention does not attack metal on the substrate surface or alter the surface chemistry so that the substrate has the undesirable characteristic of wetting after subsequent cleaning.

The method of this invention comprises:

(1) lathing a substrate surface with a cutting fluid composition comprising:
  (A) at least one antioxidant;
  (B) at least one surfactant;
  (C) at least one lubricant; and
  (D) water;

(2) rinsing the lathed substrate surface with deionized water having a resistivity of at least 2M ohm-cm;

(3) immersing the rinsed lathed substrate surface in a bath of deionized water having a resistivity of at least 2M ohm-cm; and (4) removing the substrate from the bath of deionized water at a rate low enough to prevent water droplets from forming on the substrate.

DETAILED DESCRIPTION OF PREFERRED EMBODIMENTS

In step (1) of the method of this invention, the substrate is lathed using a cutting fluid composition. Conditions for lathing with this cutting fluid are essentially identical to those applied when a petroleum-based fluid is used. For example, the aluminum substrates may be mounted horizontally on the lathe and turned at a rotation speed of about 4000 rpm. Preferably, two cutting passes are made on the substrate, the first being a rough cut made at a traverse speed of about 720 mm/min. The final cut is preferably made using a traverse speed of about 900 mm/min. During each pass, cutting fluid is preferably continuously sprayed onto the substrate at the point where the cutting tool contacts the substrate. During each pass about 10 milliliters of fluid may preferably be sprayed onto the substrate.

In step (2), the substrate is rinsed with high quality deionized water having a resistivity of at least 2M ohm-cm. Preferably, the deionized water has a resistivity ranging from about 2.0 to about 10.0M ohm-cm.

Preferably, the substrate is spray rinsed with the deionized water. Pressurized spray rinsing is preferred for the first rinse because the impingement force of the spray will aid in removing the residual cutting fluid.

The deionized water is preferably sprayed onto the substrate at a sufficient pressure and for a sufficient time to remove substantially all of the cutting fluid residuals from the substrate. Preferably, the substrate is spray rinsed using pressures of from about 25 to about 75 psi and more preferably about 50 psi, for a period preferably of from about 0.5 to about 1.5 minutes and more preferably about 1 minute while rotating at a speed of from about 50 to about 150 rpm. More preferably, the substrate is spray rinsed at a pressure of about 50 psi for about 1 minute at a speed of about 100 rpm.

In step (3) of the method of this invention, the substrate is immersed in a bath of deionized water having a resistivity of at least 2M ohm-cm. Preferably, the deionized water has a resistivity of from about 2 to about 10M ohm-cm.

Preferably, the bath is a recirculating tank of deionized water. Also, preferably, the bath is maintained at a temperature ranging from about 60° C. to about 75° C.

The substrate is kept in the bath of deionized water for a period sufficient to allow the substrate to equilibrate to the temperature of the deionized rinse water. Preferably, the substrate is kept in the bath for a time period ranging from about 0.5 to about 1.5 minutes and more preferably about 1 minute.

The substrate is removed from the bath of deionized water at a rate low enough to prevent water droplets from forming on the substrate. Such water droplets can result in post-coat print artifacts. Preferably, the substrate is removed from the bath at a rate of less than about 5 centimeters per second, more preferably from about 2 to about 3 centimeters per second and most preferably less than 2.5 centimeters per second.

The cutting fluid used in the method of this invention contains (A) an antioxidant; (B) a surfactant; (C) a lubricant; and (D) water. The cutting fluid is disclosed in copending, commonly assigned U.S. patent application Ser. No. 08/143,720 (JAO 29006), filed simultaneously with the instant application and incorporated by reference herein.

Preferably, the cutting fluid contains (A) from about 0.1 to about 10 parts by weight of antioxidant; (B) from about 0.1 to about 5 parts by weight of surfactant; (C) from about 1 to about 20 parts by weight of lubricant; and (D) from about 65 to about 98.8 parts by weight of water, the sum of (A)–(D) being 100 parts by weight.

More preferably, the cutting fluid contains (A) from about 0.5 to about 2 parts by weight of antioxidant; (B) from about 0.5 to about 3 parts by weight of surfactant; (C) from about 2 to about 10 parts by weight of lubricant; and (D) from about 85 to about 97 parts by weight of water, the sum of (A)–(D) being 100 parts by weight.

Most preferably, the cutting fluid contains (A) about 1 part by weight of antioxidant; (B) about 2 parts by weight of surfactant; (C) about 10 parts by weight of lubricant; and (D) about 87 parts by weight of water.

The antioxidant (A) prevents corrosion and spontaneous combustion of any metallic fines. Preferably, the antioxidant is an amine or carboxylic acid salt. Preferred amines for use in the cutting fluid include, for example, triethanolamine, ethylene diamine tetraacetic acid (EDTA), an amine borate, or an amine carboxylate. Most preferably, the antioxidant is triethanolamine or an antioxidant commercially available from Master Chemical Corporation under the designation "Trimmist". Trimmist contains amine borate, propylene glycol, amine carboxylate, a non-ionic surfactant and a non-silicone anti-foaming agent.

The surfactant (B) provides uniform cutting fluid coverage on the substrate after machining and also facilitates removal of the cutting fluid's residues. The surfactant should be of a non-foaming type that will facilitate removal of the lubricant yet not react with metal on the substrate surface to produce etching or to increase its surface energy so that subsequent rinsing in deionized water causes the surface to remain wet.

The surfactant can be anionic, cationic or nonionic. Preferably, the surfactant is non-ionic and should have a hydrophilic/lipophilic balance (HLB) of greater than about 12 and preferably in the range of from about 12 to about 18.

Examples of suitable anionic surfactants include, for example, higher alkyl sulfonates, higher alcohol sulfuric acid esters, phosphoric acid esters, carboxylates, and the like.

Examples of suitable cationic surfactants include, for example, benzalkonium chloride, Sapamine-type quartenary ammonium salts, pyridinium salts, amine salts, and the like.

Preferably, the surfactant is non-ionic. Examples of suitable non-ionic surfactants include copolymers of propylene oxide and ethylene oxide, and ethoxylated ethanols, and the like.

Most preferably, the surfactant used in this invention is Triton X-114 (octylphenoxy polyethoxy ethanol), Pluronic L-35 (propyleneoxide/ethyleneoxide copolymer) or Alkamuls PSML20 (polyoxyethylene sorbitan monolaurate).

The lubricant (C) provides a smooth cutting action, minimizes chipping and insures minimal wear to the cutting tool. Preferably, the lubricant is a polyhydric alcohol such as a dihydric alcohol, e.g., glycol such as ethylene glycol, propylene glycol, trimethylene glycol, and neopentyl glycol; a dihydric alcohol containing ether bonds such as diethylene glycol and dipropylene glycol; a dihydric alcohol derived through nitrogen such as diethanolamine; or a dihydric alcohol containing ester bonds such as oleic acid monoglyceride.

Examples of other polyhydric alcohols include glycerin, pentaerythritol, sorbitan monolaurate, and sorbitan trioleate.

Preferably, the lubricant used in this invention is polyethylene glycol.

Water (D) functions as a coolant/diluent to control the temperature of the substrate and cutting tool and as a solvent/carrier for the other components of the cutting fluid composition of this invention. The water can be tap or deionized water. Preferably, deionized water having a resistivity greater than about 2 Mohm-cm is used.

In preferred embodiments of this invention, an acid (E) is added to the cutting fluid composition of this invention to provide the composition with a neutral pH of from about 6 to about 8. A substantially neutral pH is essential to insure no reaction with the aluminum substrate surface. More preferably, the pH is between about 7.0–7.5.

Examples of suitable acids used for neutralization include citric acid, boric acid, tartaric acid and acetic acid. Preferred acids are citric acid and boric acid.

After cutting fluid residues are removed from the substrate, the substrate may be coated with any suitable coatings to fabricate an electrostatographic imaging member, e.g., an electrophotographic imaging member or an ionographic imaging member.

To form electrophotographic imaging members, the substrate may be coated with a blocking layer, a charge generating layer, and a charge transport layer. Optional adhesive, overcoating and anti-curl layers may also be included. Alternatively, a single photoconductive layer may be applied to the substrate. If desired, the sequence of the application of coatings of multilayered photoreceptors may be varied. Thus, a charge transport layer may be applied prior to the charge generating layer. The photoconductive coating may be homogeneous and contain particles dispersed in a film-forming binder. The homogeneous photoconductive layer may be organic or inorganic. The dispersed particles may be organic or inorganic photoconductive particles. Thus, for the manufacture of electrophotographic imaging members, at least one photoconductive coating is applied to the substrate.

Ionographic imaging members are formed by coating the etched substrate with a conductive layer, a dielectric imaging layer, and an optional overcoating layer.

Experimental

EXAMPLE 1

This example illustrates the removal of cutting fluid residues according to the method of this invention.

An aluminum tube is lathed with an aqueous cutting fluid containing about 1 part by weight of triethanolamine, about 2 parts by weight of octylphenoxy polyethoxy ethanol, about 10 parts by weight of polyethylene glycol, and about 87 parts by weight of distilled water, the cutting fluid having been adjusted to a neutral pH of about 7 by the addition thereto of about 1 gram/liter of boric acid.

After lathing, the substrate is spray rinsed to remove the residual cutting fluid. Distilled water having a resistivity of about 2M ohm-cm is applied at about 50 psi for about 1 minute.

Immediately following spray rinsing, the substrate is immersed in a recirculating tank of distilled water having a resistivity of about 2M ohm-cm, which is maintained at about 60°–70° C. for about 1 minute. The substrate is then slowly withdrawn at a rate of less than about 2.5 centimeters per second to avoid surface water droplets which could result in post-coat print artifacts.

EXAMPLES 2–5

In Example 2, an aluminum drum substrate is coated with a cutting fluid containing triethanolamine, polyethylene glycol, and octylphenoxy polyethoxy ethanol surfactant ("Cutting Fluid A"). The substrate is aged for one month and then cut into three sections. The first section (Example 3) is left with the fluid intact. The second section (Example 4) is rinsed with deionized water. The third section (Example 5) is rinsed with deionized water and then subjected to a $CO_2$ snow clean.

COMPARATIVE EXAMPLES 1–4

The procedure followed in Examples 1–4 is repeated except that the cutting fluid contains a polyethylene glycol, octylphenoxy polyethoxy ethanol surfactant, and a lubricant commercially available from Parker-Amchem under the designation "Parker-Amchem 718M2" and containing several amines and a fluorocarbon surfactant ("Cutting Fluid B").

COMPARATIVE EXAMPLES 5–8

The procedure followed in Examples 5–8 is repeated except that the cutting fluid contains Parker-Amchem 718M2 lubricant ("Cutting Fluid C").

Before and after aging, the substrate and each of the sections produced in Examples 2–5 and Comparative Examples 1–8 are analyzed by X-ray photoelectron spectroscopy (XPS) which is sensitive to the topmost 2 nm of the substrate surface.

Prior to aging, the substrate shows evidence of surface condensation (due to storage) and oxidation of approximately 60% of the aluminum near the substrate surface. After aging, no additional oxidation is observed.

XPS analysis further shows that the sections prepared in Comparative Examples 1–8 each contains aluminum, carbon, fluorine (due to the surfactant) and oxygen, and that the sections prepared in Examples 2–5 each contains aluminum, carbon, and oxygen. Aluminum is barely detected in the sections prepared in Examples 2–5.

The specific concentrations of aluminum, carbon, fluorine and oxygen in the sections prepared in Examples 2–5 and Comparative Examples 1–8 are shown in Table I below.

TABLE I

| | Comparative Examples 1–8 and Examples 2–5: Concentrations | | | |
|---|---|---|---|---|
| Example No. | At % Al/ Wt % Al | At % C/ Wt % C | At % F/ Wt % F | At % O/ Wt % O |
| Comp. 1 | 15/25 | 48/36 | 4/5 | 33/34 |
| Comp. 2 | 3/5 | 51/42 | 7/9 | 40/44 |
| Comp. 3 | 5/9 | 44/35 | 5/7 | 46/49 |
| Comp. 4 | 6/12 | 45/36 | 2/2 | 46/49 |
| Comp. 5 | 2/4 | 70/62 | 4/6 | 24/28 |
| Comp. 6 | 0.4/0.8 | 71/64 | 3/4 | 26/31 |
| Comp. 7 | 5/10 | 56/46 | 4/5 | 36/39 |

TABLE I-continued

| | Comparative Examples 1–8 and Examples 2–5: Concentrations | | | |
|---|---|---|---|---|
| Example No. | At % Al/ Wt % Al | At % C/ Wt % C | At % F/ Wt % F | At % O/ Wt % O |
| Comp. 8 | 6/11 | 46/37 | 1/1 | 47/51 |
| 2 | 1/1 | 76/71 | –/– | 23/28 |
| 3 | 1/2 | 68/61 | –/– | 31/37 |
| 4 | 9/17 | 45/35 | –/– | 45/48 |
| 5 | 11/19 | 41/32 | –/– | 48/49 |

In Example 2 and Comparative Examples 1 and 5, wherein the cutting fluid-laden substrates have been aged for 1 month but not yet cleaned of the cutting fluid residues, the substrate coated with the cutting fluid used in the present invention (Example 2) shows the most complete coverage of the substrate surface by the fluid, as evidenced by the substrate exhibiting the strongest carbon signal and the weakest aluminum signal. The substrate coated in Comparative Example 1 is covered by a thin layer of the material, and signals are detected from both the fluorocarbon containing surfactant and the aluminum substrate. The substrate coated in Comparative Example 5 shows signals from the fluorocarbon surfactant and strong hydrocarbon signals. Only a weak aluminum signal is detected in this example, which indicates that a thicker layer of the cutting fluid covers the surface.

EXAMPLES 6–8

In Examples 6–8, an aluminum substrate is coated with a cutting fluid containing polysorbate, PEG, and Master Chemical Trimmist (TM).

Three sections are cut from the substrate. The first section (Example 6) is rinsed with deionized water. The second section (Example 7) is rinsed with deionized water and subjected to a $CO_2$ snow clean. The third section (Example 8) is left as is.

Each section is then tested by XPS to determine whether the cutting fluid can be removed with a simple water rinse. In each section, only aluminum, carbon and oxygen are detected. The untreated section (Example 8) contains 70% carbon, 30% oxygen and less than 1% aluminum. The section rinsed with deionized water (Example 6) contains 40% carbon, 48% oxygen, and 12% aluminum. The section rinsed with deionized water and subjected to a $CO_2$ snow clean (Example 7) contains 38% carbon, 50% oxygen and 12% aluminum. Thus, the combined water and $CO_2$ cleaning treatment further reduces carbon contamination. However, $CO_2$ cleaning treatment does not significantly improve cleaning. Thus, rinsing with deionized water alone is generally equivalent to the combined water/$CO_2$ cleaning treatment.

XPS analysis of the sections prepared in Examples 6–8 shows that rinsing with water is sufficient to remove the cutting fluid from the sections.

COMPARATIVE EXAMPLES 9–17

In Comparative Examples 9–11, an aluminum substrate section is lathed with a cutting fluid containing a 10% aqueous solution of Parker-Amchem 718M2 lubricant ("Cutting Fluid D"). In Comparative Examples 12–14, an aluminum substrate section is lathed with a 2.5% aqueous solution of a cutting fluid commercially available from Master Chemical Corporation under the designation "Master Chemical Trimmist" and containing amine borates, propylene glycol, amine carboxylates, non-ionic surfactants and a nonsilicone anti-foaming agent ("Cutting Fluid E"). In Comparative Examples 15–17, an aluminum substrate section is lathed with a 2.5% aqueous solution of a cutting fluid commercially available from Castrol under the designation "Castrol Hysol X" and containing an oil-in-water emulsion containing petroleum distillates and an alkanolamine. ("Cutting Fluid F").

The cutting fluid and lubricant additive used in Comparative Examples 9–17 are set forth in Table II below.

TABLE II

| Examples 9–17: Cutting Fluid and Lubricant | | |
|---|---|---|
| Example No. | Cutting Fluid | Lubricant Additive |
| 9 | D | None |
| 10 | D | 2% PEG |
| 11 | D | 2% TC 157* |
| 12 | E | None |
| 13 | E | 2% PEG |
| 14 | E | 2% TC 157 |
| 15 | F | None |
| 16 | F | 2% PEG |
| 17 | F | 2% TC 157 |

*A surfactant commercially available from Parker Amchem

Each section is then subjected to the following treatment:

(1) 6 hours after lathing, a 30 second rinse with deionized water at room temperature and then immersion for 10 seconds in deionized water at room temperature ("DI Rinse 1");

(2) 6 hours after lathing, immersion for 30 seconds into a 3% aqueous solution of a phosphate-containing mild alkaline cleaner with a pH of 9.5 and commercially available from Parker Amchem under the designation "VR5220" followed by a 30 second immersion into the cleaner at 85°–90° F. accompanied by ultrasonic energy ("A Clean");

(3) 24 hours after lathing, a 30 second rinse with deionized water at room temperature and then immersion for 10 seconds in deionized water at room temperature ("DI Rinse 2");

(4) 24 hours after lathing, a 30 second immersion into a 3% aqueous solution of a mildly alkaline cleaner commercially available under the designation "Chautaugua GP-M" and containing propylene ("B Clean");

(5) 30 hours after lathing, a 30 second rinse with deionized water at room temperature and then immersion for 10 seconds in deionized water at room temperature ("DI Rinse 3");

(6) 6 hours after lathing, immersion for 30 seconds into the cleaner used in "A Clean" and a 30 second immersion accompanied by ultrasonic energy at 85°–90° F. of ("C Clean").

After each step of the treatment, the sections are tested for $H_2O$ break, residue, and fog spots. The sections are also tested for cleanliness by means of a device made by Photoacoustics Technology which measures the level of organic residue and aluminum oxide on the section. A measurement ("PAT") of 1150 and above means that there is no organic residue and very little aluminum oxide while a reading of less than 1150 indicates the presence of organic residue or aluminum oxide. The results are shown in Tables III–XI below. In the tables below, the following rating is used:

0—no evaluation made
1—poor
2—fair
3—good,

TABLE III

| Comparative Example 9: Properties | | | | |
|---|---|---|---|---|
| Step | $H_2O$ | Residue | Fog Spots | PAT |
| DI Rinse 1 | 1 | 3 | 2 | 1148–1149 |
| A Clean | 0 | 0 | 0 | 0 |
| DI Rinse 2 | 3 | 3 | 2 | 1148–1149 |
| B Clean | 0 | 0 | 0 | 0 |
| DI Rinse 3 | 3 | 3 | 2 | 1146–1147 |
| C Clean | 0 | 0 | 0 | 0 |

TABLE IV

| Comparative Example 10: Properties | | | | |
|---|---|---|---|---|
| Step | $H_2O$ | Residue | Fog Spots | PAT |
| DI Rinse 1 | 3 | 3 | 2 | 1146 |
| A Clean | 1 | 0 | 0 | 0 |
| DI Rinse 2 | 3 | 3 | 3 | 1148–1149 |
| B Clean | 1 | 0 | 0 | 0 |
| DI Rinse 3 | 3 | 3 | 3 | 1148–1149 |
| C Clean | 2 | 0 | 2 | 0 |

TABLE V

| Comparative Example 11: Properties | | | | |
|---|---|---|---|---|
| Step | $H_2O$ | Residue | Fog Spots | PAT |
| DI Rinse 1 | 3 | 3 | 3 | 1145–1148 |
| A Clean | 2* | 0 | 0 | 0 |
| DI Rinse 2 | 3 | 3 | 3 | 1148–1150 |
| B Clean | 0 | 0 | 0 | 0 |
| DI Rinse 3 | 3 | 3 | 3 | 1148–1149 |
| C Clean | 0 | 0 | 0 | 0 |

*Ultrasonic Pitting

TABLE VI

| Comparative Example 12: Properties | | | | |
|---|---|---|---|---|
| Step | $H_2O$ | Residue | Fog Spots | PAT |
| DI Rinse 1 | 3 | 2 | 2 | 1115–1130 |
| A Clean | 0 | 3 | 2 | 1148 |
| DI Rinse 2 | 3 | 2 | 2 | 814–832 |
| B Clean | 3 | 3 | 1 | 0 |
| DI Rinse 3 | 2 | 2 | 2 | 827–897 |
| C Clean | 3 | 3 | 1 | 1145–1147 |

*Ultrasonic Pitting

TABLE VII

| Comparative Example 13: Properties | | | | |
|---|---|---|---|---|
| Step | $H_2O$ | Residue | Fog Spots | PAT |
| DI Rinse 1 | 3 | 1 | 1 | 1146–1149 |
| A Clean | 0 | 3 | 2 | 1150–1152 |
| DI Rinse 2 | 3 | 2 | 2 | 788–926 |
| B Clean | 3* | 3 | 1 | 976–1025 |
| DI Rinse 3 | 3 | 2 | 2 | 845–980 |
| C Clean | 3 | 3 | 2 | 1144–1146 |

*Ultrasonic Pitting

TABLE VIII

| Comparative Example 14: Properties | | | | |
|---|---|---|---|---|
| Step | $H_2O$ | Residue | Fog Spots | PAT |
| DI Rinse 1 | 3 | 0 | 2 | 1145–1148 |
| A Clean | 3 | 3 | 2 | 1150 |
| DI Rinse 2 | 3 | 2 | 1 | 982–1045 |
| B Clean | 3 | 3 | 2 | 1033–1060 |
| DI Rinse 3 | 3 | 3 | 2 | 883–999 |
| C Clean | 3 | 3 | 2 | 1146–1147 |

TABLE IX

| Step | Comparative Example 15: Properties | | | |
|---|---|---|---|---|
| | $H_2O$ | Residue | Fog Spots | PAT |
| DI Rinse 1 | 3 | 1 | 1 | 1145 |
| A Clean | 0 | 3 | 2 | 1148 |
| DI Rinse 2 | 3 | 1 | 1 | 806–986 |
| B Clean | 0 | 3 | 1 | 1149–1150 |
| DI Rinse 3 | 3 | 1 | 1 | 882–1028 |
| C Clean | 2 | 3 | 1 | 1144–1147 |

TABLE X

| Step | Comparative Example 16: Properties | | | |
|---|---|---|---|---|
| | $H_2O$ | Residue | Fog Spots | PAT |
| DI Rinse 1 | 3 | 1 | 1 | 1144–1146 |
| A Clean | 0 | 3 | 2 | 1149–1150 |
| DI Rinse 2 | 3 | 1 | 1 | 862–888 |
| B Clean | 3* | 3 | 1 | 1148–1150 |
| DI Rinse 3 | 3 | 1 | 1 | 800–937 |
| C Clean | 3 | 3 | 1 | 1146–1148 |

*Ultrasonic Pitting

TABLE XI

| Step | Comparative Example 17: Properties | | | |
|---|---|---|---|---|
| | $H_2O$ | Residue | Fog Spots | PAT |
| DI Rinse 1 | 3 | 1 | 1 | 1144–11468 |
| A Clean | 0 | 3 | 1 | 1144–1148 |
| DI Rinse 2 | 0 | 1 | 1 | 1126–1145 |
| B Clean | 0* | 3 | 1 | 1146–1149 |
| DI Rinse 3 | 3 | 1 | 1 | 965–1040 |
| C Clean | 3 | 3 | 1 | 1146–1147 |

*Ultrasonic Pitting

EXAMPLE 9

In Example 9, an aluminum substrate is coated with a cutting fluid containing a 1.5% aqueous solution of TM fluid, a 3% aqueous solution of polyethylene glycol, a 2% aqueous solution of octylphenoxy polyethoxy ethanol, and a 0.2% aqueous solution of TEA. The substrate then undergoes "D1 Rinse 1" and "E Clean". "E Clean " refers to a process wherein 6 hours after lathing the substrate is immersed for 30 seconds in Ridoline 143 and then a 30 second immersion into the Ridoline 143 cleaner at 14020 F. and accompanied by ultrasonic energy. The $H_2O$ break, residue, fog spots, and PAT data for this example are presented in Table XII.

TABLE XII

| Step | Example 9: Properties | | | |
|---|---|---|---|---|
| | $H_2O$ | Residue | Fog Spots | PAT |
| DI Rinse 1 | 3 | 3 | 3 | 950–1050 |
| E Clean | 3 | 3 | 3 | 1050–1100 |

EXAMPLE 10

The procedure of Example 9 is repeated except that the cutting fluid further contains a 1% aqueous solution of polyglycol ester. The $H_2O$ break, residue, fog spots and PAT values are presented in Table XIII.

TABLE XIII

| Step | Example 10: Properties | | | |
|---|---|---|---|---|
| | $H_2O$ | Residue | Fog Spots | PAT |
| DI Rinse 1 | 2 | 2 | 1 | 190–260 |
| E Clean | 2 | 2 | 2 | |

EXAMPLE 11

The procedure followed in Example 9 is repeated except that the cutting fluid contains a 1% aqueous solution of polyethylene glycol, a 0.1% aqueous solution of Zonyl FSN (a fluorinated surfactant commercially available from DuPont), and a 0.2% aqueous solution of TEA and the "E Clean" step was omitted. The $H_2O$ break, residue, fog spots and PAT values are presented in Table XIV.

TABLE XIV

| Step | Example 11: Properties | | | |
|---|---|---|---|---|
| | $H_2O$ | Residue | Fog Spots | PAT |
| DI Rinse 1 | 3 | 3 | 1 | 1150 |

EXAMPLE 12

The procedure followed in Example 9 is repeated except that the cutting fluid contains a 2.5% aqueous solution of TM, a 2% aqueous solution of polyethylene glycol, a 1% aqueous solution of octylphenoxy polyethoxy ethanol, and a 0.1% aqueous solution of Zonyl FSN, the pH of the cutting fluid being adjusted to 7 by addition of citric acid. Furthermore, in Example 12, the "E Clean" step is omitted and replaced with "D1 Rinse 2" and "D1 Rinse 3". The $H_2O$ break, residue, fog spots and PAT values are shown in Table XV.

TABLE XV

| Step | Example 12: Properties | | | |
|---|---|---|---|---|
| | $H_2O$ | Residue | Fog Spots | PAT |
| DI Rinse 1 | 3 | 3 | 3 | 1150 |
| DI Rinse 2 | 3 | 3 | 3 | 1150 |
| DI Rinse 3 | 3 | 3 | 3 | 1150 |

The results of the foregoing examples illustrate that the process of the present invention provides excellent water break, low residues, and high PAT values.

What is claimed is:

1. A method of cleaning a substrate comprising:

(1) lathing a substrate surface with a cutting fluid composition comprising:

(A) at least one antioxidant;

(B) at least one surfactant;

(C) at least one lubricant; and (D) water;

(2) rinsing the lathed substrate surface with deionized water having a resistivity of at least 2M ohm-cm;

(3) immersing the rinsed lathed substrate surface in a bath of deionized water having a resistivity of at least 2M ohm-cm; and (4) removing the substrate from the bath of deionized water at a rate which prevents water droplets from forming on the substrate.

2. A method according to claim 1, wherein the deionized water in steps (2) and (3) has a resistivity ranging from about 2 to about 10M ohm-cm.

3. A method according to claim 1, wherein in step (2) the substrate is spray rinsed with the deionized water at a pressure of from about 25 to about 75 psi.

4. A method according to claim 1, wherein in step (2) the substrate is rinsed with the deionized water for a period of from about 0.5 to about 1.5 minutes.

5. A method according to claim 10 wherein in step (3) the substrate is immersed in the bath of deionized water for a period of from about 0.5 to about 1.5 minutes.

6. A method according to claim 1, wherein the bath of deionized water is maintained at a temperature ranging from about 60° C. to about 75° C.

7. A method according to claim 1, wherein the substrate is withdrawn from the bath of deionized water at a rate of less than about 2.5 centimeters per second.

8. A method according to claim 1, wherein the cutting fluid comprises:

(A) from about 0.1 to about 10 parts by weight of the at least one antioxidant;

(B) from about 0.1 to about 5 parts by weight of the at least one surfactant;

(C) from about 1 to about 20 parts by weight of the at least one lubricant; and (D) from about 65 to about 98.8 parts by weight of water; the sum of (A)-(D) being 100 parts by weight.

9. A method according to claim 1, wherein the cutting fluid comprises:

(A) from about 0.5 to about 2 parts by weight of the at least one antioxidant;

(B) from about 0.5 to about 3 parts by weight of the at least one surfactant;

(C) from about 2 to about 10 parts by weight of the at least one lubricant; and (D) from about 85 to about 97 parts by weight of water; the sum of (A)-(D) being 100 parts by weight.

10. A method according to claim 1, wherein the at least one antioxidant is an amine or carboxylic acid salt.

11. A method according to claim 1, wherein the at least one antioxidant comprises at least one member selected from the group consisting of triethanolamine, ethylene diamine tetraacetic acid, an amine borate, and an amine carboxylate.

12. A method according to claim 10 wherein the at least one surfactant is a non-ionic, non-foaming surfactant.

13. A method according to claim 1, wherein the at least one surfactant comprises at least one member selected from the group consisting of a copolymer of propylene oxide and ethylene oxide and an ethoxylated ethanol.

14. A method according to claim 1, wherein the at least one surfactant comprises at least one member selected from the group consisting of octylphenoxy polyethoxy ethanol, propyleneoxide/ethyleneoxide copolymer or polyoxyethylene sorbitan monolaurate.

15. A method according to claim 1, wherein the at least one lubricant comprises a polyhydric alcohol or a polymer of a polyhydric alcohol.

16. A method according to claim 1, wherein the at least one lubricant comprises at least one member selected from the group consisting of dihydric alcohol, a dihydric alcohol containing ether bonds, a dihydric alcohol derived through nitrogen, and a dihydric alcohol containing ester bonds.

17. A method according to claim 1, wherein the at least one lubricant is glycerin, polyethylene glycol, pentaerythritol, sorbitan monolaurate or sorbitan trioleate.

18. A method according to claim 1, wherein the water (D) is deionized water.

19. A method according to claim 1, wherein the cutting fluid composition further comprises (E) an acid in an amount sufficient to provide the cutting fluid with a pH of from about 6 to about 8.

20. A method according to claim 19, wherein the acid (E) comprises at least one member selected from the group consisting of citric acid, boric acid, tartaric acid and acetic acid.

21. A method according to claim 1, wherein the substrate is a photoreceptor substrate.

22. A method according to claim 1, wherein the substrate is aluminum.

23. A method of cleaning a substrate comprising:

(1) lathing a substrate with a cutting fluid composition comprising:

(A) about 1 part by weight of triethanolamine;

(B) about 2 parts by weight of octylphenoxy polyethoxyethanol;

(C) about 10 parts by weight of polyethylene glycol; and (D) about 87 parts by weight of deionized water;

(2) spray rinsing the substrate at a pressure of about 50 psi for about 1 minute with deionized water having a resistivity of greater than about 2M ohm-cm;

(3) immersing the rinsed lathed substrate surface in a bath of deionized water having a resistivity of at least 2M ohm-cm for about 1 minute; and (4) removing the substrate from the bath of deionized water at a rate of less than about 2.5 centimeters per second.

24. A method of cleaning a substrate comprising:

(1) lathing a substrate with a cutting fluid composition comprising:

(A) about 2.5 parts by weight of an antioxidant containing an amine borate, propylene glycol, amine carboxylate, a non-ionic surfactant, and a non-silicone anti-foaming agent;

(B) about 1 part by weight of octylphenoxy polyethoxyethanol;

(C) about 2 parts by weight of polyethylene glycol; and (D) about 94.5 parts by weight of deionized water;

(2) rinsing the lathed substrate surface with deionized water having a resistivity of at least 2M ohm-cm;

(3) immersing the rinsed lathed substrate surface in a bath of deionized water having a resistivity of at least 2M ohm-cm; and (4) removing the substrate from the bath of deionized water at a rate which prevents water droplets from forming on the substrate.

* * * * *